US009946212B2

(12) United States Patent
Sakuma et al.

(10) Patent No.: US 9,946,212 B2
(45) Date of Patent: Apr. 17, 2018

(54) SIDE EDGE REMOVAL FOR POST PROCESSING

(71) Applicant: FUJI XEROX CO., LTD., Tokyo (JP)

(72) Inventors: Akira Sakuma, Kanagawa (JP); Yoshiyuki Takaishi, Kanagawa (JP); Daisuke Ishikawa, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 136 days.

(21) Appl. No.: 14/852,759

(22) Filed: Sep. 14, 2015

(65) Prior Publication Data

US 2016/0282794 A1 Sep. 29, 2016

(30) Foreign Application Priority Data

Mar. 26, 2015 (JP) ..... 2015-065221

(51) Int. Cl.
*B65H 35/02* (2006.01)
*G03G 15/00* (2006.01)
*B65H 37/06* (2006.01)

(52) U.S. Cl.
CPC ..... *G03G 15/6582* (2013.01); *B65H 37/06* (2013.01); *G03G 2215/00814* (2013.01)

(58) Field of Classification Search
CPC ..... G03G 15/6582; G03G 1215/00814; B65H 37/06
USPC ..... 270/5.03, 52.17; 83/167
See application file for complete search history.

(56) References Cited

U.S. PATENT DOCUMENTS 3,791,246 A * 2/1974 Lazickas ..... B26F 1/3826 83/375
6,572,093 B1 * 6/2003 Scholta ..... B42B 4/00 270/52.17
9,091,993 B2 7/2015 Sakuma et al.
2007/0026101 A1 * 2/2007 Arai ..... G03G 15/6582 425/306
2015/0000488 A1 * 1/2015 Yanagawa ..... B65H 35/02 83/73
2015/0001782 A1 * 1/2015 Sakuma ..... G03G 15/6582 270/21.1
2015/0266693 A1 * 9/2015 Kiriyama ..... B26D 7/2635 83/107
2016/0282794 A1 * 9/2016 Sakuma ..... G03G 15/6582

FOREIGN PATENT DOCUMENTS

JP 2006-199428 A 8/2006
JP 2009-126690 A 6/2009
JP 2015-009970 A 1/2015

OTHER PUBLICATIONS www.leancrew.com/all-this/2012/01/crumpled (Year: 2012).*

* cited by examiner

*Primary Examiner* — Patrick H Mackey
(74) *Attorney, Agent, or Firm* — Sughrue Mion, PLLC

(57) ABSTRACT

A post-processing apparatus includes a side edge removing unit that removes a side edge of a sheet, and a rigidity imparting unit that imparts rigidity to the side edge that is removed by the side edge removing unit such that the side edge has a higher rigidity in a longitudinal direction of the side edge than a body of the sheet from which the side edge is removed.

10 Claims, 6 Drawing Sheets

SIDE EDGE REMOVAL FOR POST PROCESSING

CROSS-REFERENCE TO RELATED APPLICATIONS

This application is based on and claims priority under 35 USC 119 from Japanese Patent Application No. 2015-065221 filed Mar. 26, 2015.

BACKGROUND (i) Technical Field

The present invention relates to a post-processing apparatus, an image forming system, and a post-processing method.

(ii) Related Art

When producing a booklet or the like, post-processing such as side edge removal (vertical trimming) for removing (cutting) the side edge of a sheet or a booklet is performed after image formation. The removed side edge is stored in a storing box.

SUMMARY

According to an aspect of the invention, there is provided a post-processing apparatus including: a side edge removing unit that removes a side edge of a sheet; and a rigidity imparting unit that imparts rigidity to the side edge that is removed by the side edge removing unit such that the side edge has a higher rigidity in a longitudinal direction of the side edge than a body of the sheet from which the side edge is removed.

BRIEF DESCRIPTION OF THE DRAWINGS

An exemplary embodiment of the present invention will be described in detail based on the following figures, wherein:

FIGS. 3A and 3B are diagrams illustrating a cutter unit included in a side edge removing section, in which FIG. 3A illustrates the configuration of the cutter unit and FIG. 3B illustrates a side edge of a sheet;

FIGS. 4A and 4B are diagrams illustrating the configuration of a chip storing unit, in which FIG. 4A is a perspective view of the chip storing unit and FIG. 4B is a side view of the chip storing unit in the post-processing apparatus;

FIGS. 6A and 6B are diagrams illustrating another configuration of the chip storing unit, in which FIG. 6A is a perspective view of the chip storing unit and FIG. 6B is a side view of the chip storing unit in the post-processing apparatus.

DETAILED DESCRIPTION

An exemplary embodiment of the present invention will now be described with reference to the accompanying drawings.

Description of Image Forming System 100

Figure 1:
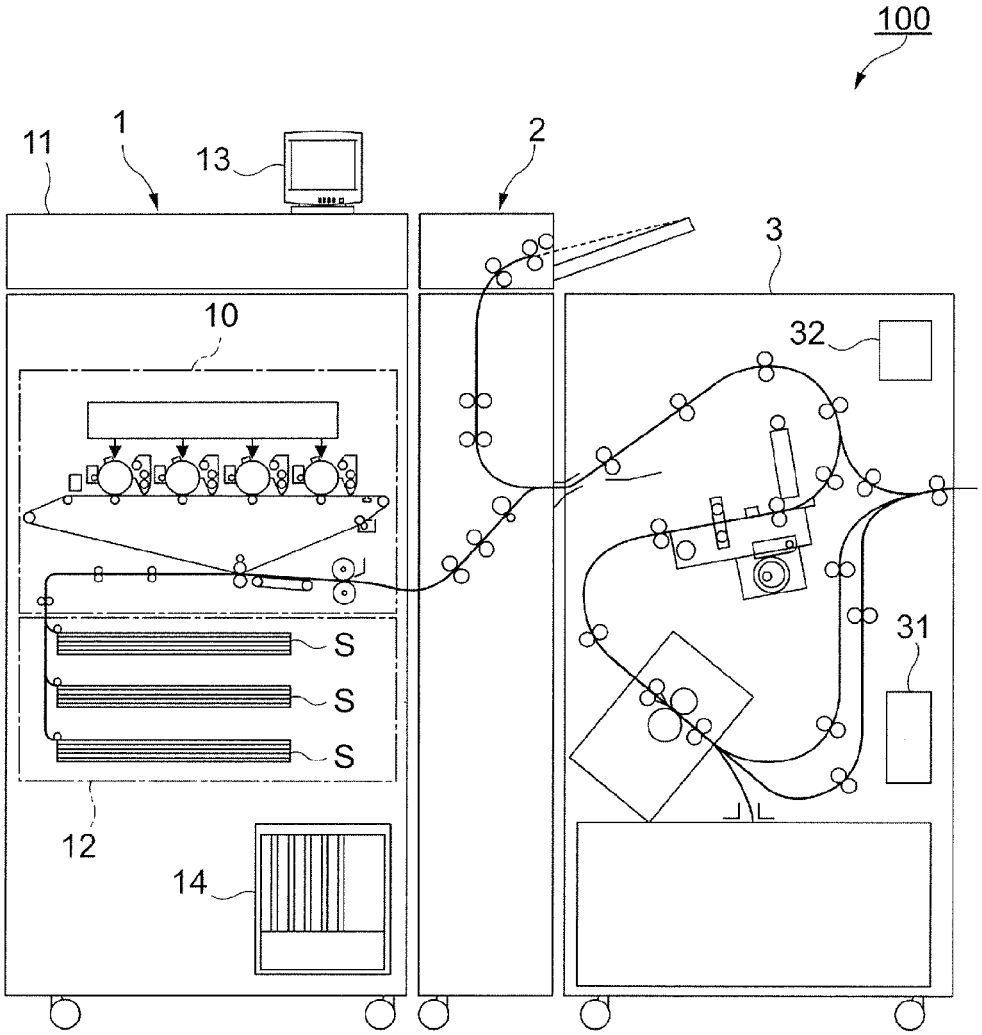
FIG. 1 illustrates the overall configuration of an image forming system to which an exemplary embodiment is applied.

FIG. 1 illustrates the overall configuration of an image forming system 100 to which this exemplary embodiment is applied. The image forming system 100 illustrated in FIG. 1 includes an image forming apparatus 1, such as a printer and a copier, that forms a color image using an electrophotographic system, for example, a sheet insertion apparatus 2 that receives and transports a sheet S with an image formed thereon and inserts another sheet S, and a post-processing apparatus 3 that performs post-processing on the sheet S with the image formed thereon by the image forming apparatus 1.

The sheet insertion apparatus 2 is regarded as a sheet transport apparatus that transports a sheet S on which an image is formed by the image forming apparatus 1. However, the sheet insertion apparatus 2 also has a function of inserting an additional sheet S on which an image is formed separately into a transport path.

Further, the post-processing apparatus 3 has a function of transporting the sheet S, and may be regarded as a sheet transport apparatus.

In the following description, both a sheet with an image formed thereon by the image forming apparatus 1 and a sheet supplied from the sheet insertion apparatus 2 are referred to as sheets S.

The image forming apparatus 1 includes an image forming unit 10 that forms an image on a sheet S on the basis of image data of each color. The image forming unit 10 forms an image of the sheet S using an inkjet system, an electrophotographic system, or the like.

The image forming apparatus 1 further includes an image reading unit 11 that reads an image from a document and generates read image data, a sheet supply unit 12 that supplies a sheet S to the image forming unit 10, and a general user interface 13 that receives an operation input from the user and presents information to the user.

The image forming apparatus 1 further includes a controller 14. The controller 14 includes a central processing unit (CPU) and a read only memory (ROM), and controls the entire operations of the image forming system 100.

The sheet insertion apparatus 2 inserts an additional sheet S on which an image is formed separately, such as a cover of a booklet to be produced, into the transport path of a sheet S on which an image is formed by the image forming apparatus 1. That is, assuming that the image forming apparatus 1 forms an image on a sheet S to be the body of a booklet, the sheet insertion apparatus 2 supplies a sheet S to be the cover to the flow of the sheet S to be the body.

The post-processing apparatus 3 includes plural processing units, such as a fold line forming unit 307 (see FIG. 2, described below) that forms a fold line on the sheet S and a side edge removing section 308 (see FIG. 2, described below) that performs side edge removal (vertical trimming).

Although not illustrated in FIG. 1, in the image forming system 100, the post-processing apparatus 3 may be connected to an apparatus that actually performs folding processing on the sheet S transported out of the post-processing apparatus 3, and then to a finisher apparatus that produces a booklet (performs bookbinding) by punching the folded sheet S, performing stapling (side stitching) to the end of a sheet bundle of a required number of sheets S, or performing stitching (saddle stitching) on the center of a sheet bundle. Thus, the image forming system 100 is configured so as to be able to continuously perform a series of operations (print units) for making a booklet, for example.

The post-processing apparatus 3 further includes a post-processing controller 31. The post-processing controller 31 includes a central processing unit (CPU) and a read only memory (ROM), and controls the functional units of the post-processing apparatus 3. The post-processing apparatus 3 further includes a user interface (UI) 32 that receives an operation input related to post-processing from the user.

Note that although the post-processing controller 31 is disposed in the post-processing apparatus 3 in the configuration example illustrated in this exemplary embodiment, the post-processing controller 31 may be disposed in the image forming apparatus 1. Further, the controller 14 may provide the control functions of the post-processing controller 31.

Further, although the user interface 32 is disposed in the post-processing apparatus 3 in the configuration example illustrated in this exemplary embodiment, the user interface 32 may be disposed in the image forming apparatus 1. Further, the general user interface 13 may provide the functions of the user interface 32.

Figure 2:
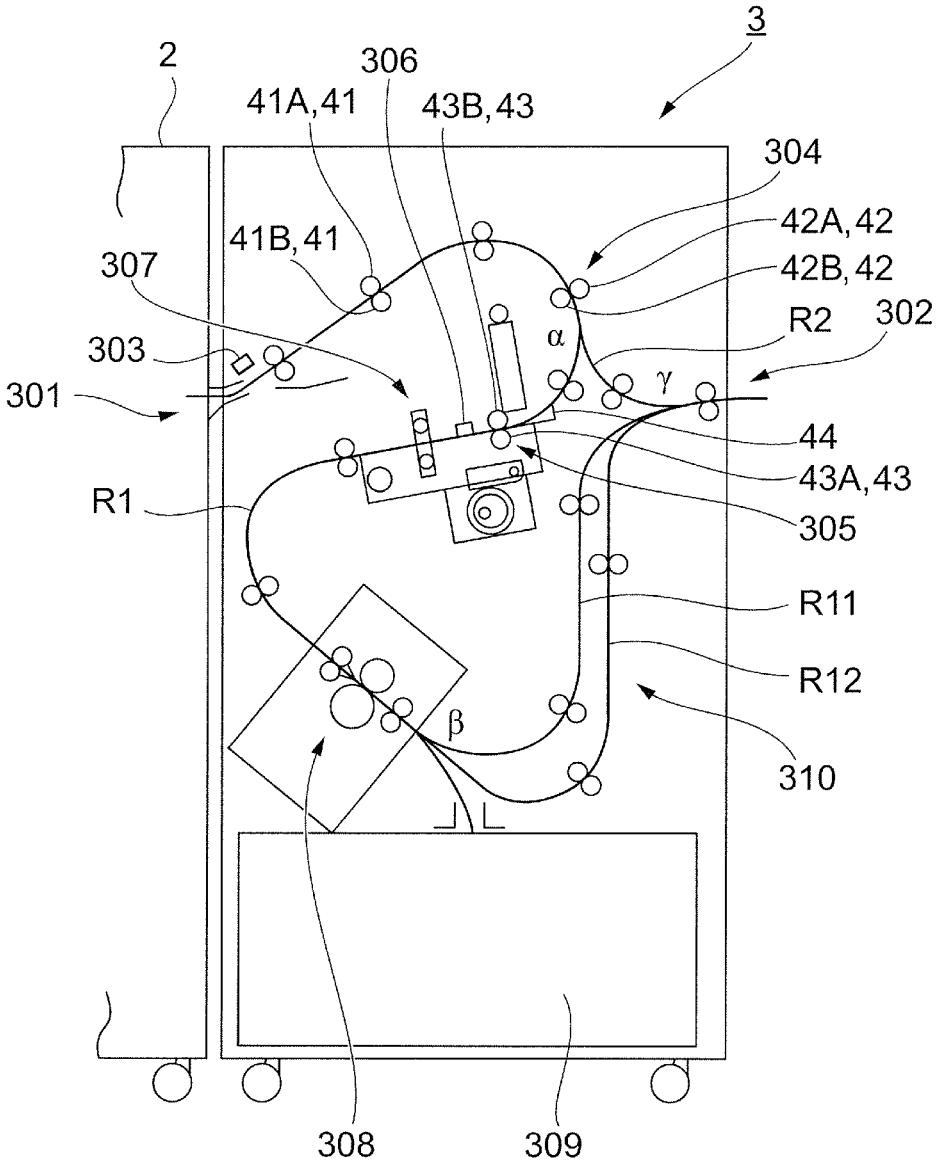
FIG. 2 is a diagram illustrating a post-processing apparatus.

Description of Post-Processing Apparatus 3 FIG. 2 is a diagram illustrating the post-processing apparatus 3.

The post-processing apparatus 3 is provided with a receiving port 301 for receiving the sheet S transported from the image forming apparatus 1, and an ejection port 302 for ejecting the sheet S.

Further, the post-processing apparatus 3 includes an inclination detecting unit 303 that detects an inclination (skew) of the received sheet S with respect to the direction of the flow of the sheet S, a first inclination correcting unit 304 including a swing roller pair 42 that corrects the inclination, a second inclination correcting unit 305 that corrects the inclination by causing the leading edge of the sheet S to abut against a correction roller pair 43, an end position detecting unit 306 that detects positions of the opposite ends of the sheet S, the fold line forming unit 307 that forms a fold line in the sheet S, a side edge removing section (vertical trimmer) 308 that removes side edges CS of the sheet S, and a chip storing unit 309 as an example of a side edge storing unit that stores the removed side edges CS of the sheet S as chips.

The post-processing apparatus 3 further includes a first sheet transport path R1 through which the sheet S passes. This first sheet transport path R1 starts at the receiving port 301, and extends toward the ejection port 302.

Further, the first sheet transport path R1 is disposed so as to pass through the inclination detecting unit 303, the first inclination correcting unit 304, the second inclination correcting unit 305, the end position detecting unit 306, the fold line forming unit 307, and the side edge removing section (vertical trimmer) 308. Along this path, the sheet S received at the receiving port 301 is transported to the inclination detecting unit 303, the first inclination correcting unit 304, the second inclination correcting unit 305, the end position detecting unit 306, the fold line forming unit 307, and the side edge removing section 308.

Note that the first sheet transport path R1 is divided into a first branch path R11 and a second branch path R12, at the downstream side of the side edge removing section 308 (a section denoted by β, hereinafter referred to as a section β). Then, the first branch path R11 and the second branch path R12 meet in front of the ejection port 302 (a section denoted by γ, hereinafter referred to as a section γ).

The post-processing apparatus 3 further includes a second sheet transport path R2.

The second sheet transport path R2 is disposed so as to branch off the first sheet transport path R1. More specifically, the second sheet transport path R2 branches off the first sheet transport path R1, at the downstream side of the first inclination correcting unit 304 and the upstream side of the fold line forming unit 307 (a section denoted by α, hereinafter referred to as a section α). Further, the second sheet transport path R2 starts at a point connected to the first sheet transport path R1, and extends toward the ejection port 302.

The sheet S that is not the subject of formation of a fold line by the fold line forming unit 307 and removal of side edges by the side edge removing section 308 is transported through the second sheet transport path R2 toward the ejection port 302.

Each of the first sheet transport path R1 and the second sheet transport path R2 is configured as a passage (chute) formed between two metal plates, for example. Thus, the sheet S is transported between the two metal plates.

Further, at each of the section α where the second sheet transport path R2 branches off the first sheet transport path R1, the section β where the first sheet transport path R1 is divided into the first branch path R11 and the second branch path R12, the section γ where the first branch path R11, the second branch path R12, and the second sheet transport path R2 meet, a gate is provided that is made of a metal plate and switches the path of the sheet S by guiding the sheet S with the metal plate.

Further, each of the first sheet transport path R1 and the second sheet transport path R2 is provided with plural transport roller pairs 41 that transport the sheet S located on these sheet transport paths toward the downstream side.

Each of the transport roller pairs 41 includes a driving roller 41A that is rotated by a motor, and a driven roller 41B that is disposed at a position facing the driving roller 41A and is rotated by a driving force from the driving roller 41A.

Each of the driving roller 41A and the driven roller 41B includes a shaft made of metal or the like and plural cylindrical elastic bodies made of rubber or the like attached to the shaft.

In each transport roller pair 41, the driving roller 41A rotates while the elastic body of the driving roller 41A and the elastic body of the driven roller 41B are in contact with each other (contact state). Then, the driven roller 41B in contact with the driving roller 41A is driven.

When the sheet S is held (nipped) between the driving roller 41A and the driven roller 41B, the sheet S moves in the direction in which the driving roller 41A and the driven roller 41B rotate.

The elastic bodies of the driving roller 41A and the driven roller 41B of each transport roller pair 41 are disposed so as to be in contact with each other at a part of the passage formed between two metal plates where a portion of each of the metal plates is cut out.

Note that under the post-processing controller 31 (see FIG. 1), either one or each of the driving roller 41A and the driven roller 41B is released from the contact state and moves to a position away from (moves away from) the other roller.

Further, as illustrated in FIG. 2, the first sheet transport path R1 is bent in an S-shape in order to save the space of the post-processing apparatus 3.

Further, the receiving port 301 and the ejection port 302 of the post-processing apparatus 3 are disposed at the same height. Thus, in the case where the post-processing apparatus 3 is not provided, an apparatus that performs folding processing, a finisher apparatus, or the like is connected to the image forming apparatus 1.

Now, a description will be given of the functional units included in the post-processing apparatus 3.

The inclination detecting unit 303 includes, for example, two detecting members in a direction perpendicular to the flow of the sheet S. Each of the detecting members includes a pair of a light emitting element and a light receiving element. When the sheet S does not pass, the light receiving element receives light emitted from the light emitting element. Then, the inclination detecting unit 303 calculates an inclination of the transported sheet S with respect to the direction perpendicular to the flow, on the basis of the difference in the time (timing) at which light is blocked by the passage of the sheet S in the two detecting members.

The first inclination correcting unit 304 includes the swing roller pair 42. Similar to the transport roller pairs 41, the swing roller pair 42 includes a driving roller 42A that is rotated by a motor, and a driven roller 42B that is disposed at a position facing the driving roller 42A and is rotated by a driving force from the driving roller 42A.

An end of the shaft each of the driving roller 42A and the driven roller 42B of the swing roller pair 42 is fixed, while the other end of the shaft may be inclined (may swing) with respect to the direction perpendicular to the flow of the sheet S. The inclination amount of the swing roller pair 42 is set in accordance with the inclination amount of the sheet S detected by the inclination detecting unit 303, immediately before the sheet S arrives.

When the sheet S is nipped between the inclined driving roller 42A and driven roller 42B of the swing roller pair 42, the swing roller pair 42 returns from the inclined state to the original non-inclined state. Thus, the inclination of the sheet S is corrected.

When returning the swing roller pair 42 from the inclined state to the original state after the sheet S is nipped by the swing roller pair 42, either one or each of the driving roller 41A and the driven roller 41B of each of the (three in FIG. 2) transport roller pair 41 disposed upstream of the swing roller pair 42 and nipping the sheet S is shifted to a state in which nipping is released. That is, the distance between the elastic bodies nipping the sheet S increases. Thus, the correction of the inclination of the sheet S by the swing roller pair 42 is easily performed.

Note that when either one of the driving roller 41A and the driven roller 41B is away from the sheet S, the sheet S moves easily. However, if the sheet S is thick (a thick sheet S), movement of the sheet S is prevented by contact with the elastic body of the driving roller 41A or the driven roller 41B. In this case, both the driving roller 41A and the driven roller 41B may be moved away from the sheet S.

After the swing roller pair 42 returns from the inclined state to the original non-inclined state and the correction of the inclination of the sheet S is completed, the driving roller 41A and the driven roller 41B of the transport roller pair 41 return to the contact state. Thus, the sheet S whose inclination is corrected by the swing roller pair 42 is transported.

The second inclination correcting unit 305 more accurately corrects the inclination of the sheet S whose inclination is corrected by the first inclination correcting unit 304. The second inclination correcting unit 305 includes the correction roller pair 43 against which the sheet S abuts such that its inclination is corrected. Similarly to the transport roller pairs 41, the correction roller pair 43 includes a driving roller 43A that is rotated by a motor, and a driven roller 43B that is disposed at a position facing the driving roller 43A and is rotated by a driving force from the driving roller 43A.

Immediately before the sheet S abuts against the correction roller pair 43, the correction roller pair 43 is held in a state in which its rotation is stopped. The sheet S abuts against the correction roller pair 43, and is pushed from the upstream side. Thus, the sheet S is bent downward by the gravity. Rotation of the correction roller pair 43 is restarted at the time when this bending occurs. Thus, the inclination of the sheet S is corrected. Note that, a bending accommodating part 44 is disposed upstream of the correction roller pair 43. The bending accommodating part 44 is disposed such that the first sheet transport path R1 curves downward.

Note that a major inclination of the sheet S is corrected in the first inclination correcting unit 304. Accordingly, the second inclination correcting unit 305 operates so as to further increase the accuracy in inclination correction.

The end position detecting unit 306 detects the ends of the sheet S in the direction perpendicular to the flow of the sheet S. That is, the width of the sheet S is not determined. For example, the positions of the ends of the sheet S are detected by a line sensor or the like. In this example, the sheets S are not aligned in the direction perpendicular to the flow of the sheet S. Therefore, the positions of the ends differ between the sheets S.

The fold line forming unit 307 includes an advancing member advancing from a side of the first sheet transport path R1 toward the first sheet transport path R1, and forms a fold line in the sheet S by pressing the advancing member against the sheet S. The sheet S is bent on the basis of the fold line by an apparatus for performing folding processing, which is provided after the post-processing apparatus 3.

By forming a fold line, folding processing is performed more smoothly.

Note that the fold line forming unit 307 may also be set so as not to form a fold line in the sheet S. That is, the fold line forming unit 307 may be set so as not to function even when the sheet S passes through the fold line forming unit 307. In this case, the sheet S moves towards the side edge removing section 308 without any fold line formed.

The side edge removing section 308 is a device that performs trimming, and removes side edges CS (side edges along the first sheet transport path R1) of the sheet S. The side edge removing section 308 includes cutter units (rotary cutter units) 50 (see FIG. 3A, described below) each having a disc-shaped blade fixed to a shaft perpendicular to the flow of the sheet S. Two cutter units 50 are disposed in the direction perpendicular to the flow of the sheet S. Thus, the side edges CS of the opposite ends of the sheet S are removed concurrently.

The width of the sheet S differs depending on a booklet to be produced. Thus, the two cutter units 50 move along the shafts thereof in accordance with the positions of the ends of the sheet S detected by the end position detecting unit 306 and the size of the side edges CS of the sheet S to be trimmed, and cut off the side edges CS of the sheet S.

The chip storing unit 309 stores, as chips, the side edges CS of the sheet S which are cut off by the side edge removing section 308.

Note that the side edge removing section 308 may also be set so as not to remove the side edges CS of the sheet S. That is, the side edge removing section 308 may be set so as not to function even when the sheet S passes through the side edge removing section 308. In this case, the sheet S moves towards the ejection port 302 without the side edges CS removed.

Now, the flow of the sheet S in the post-processing apparatus 3 will be described. First, a description will be given of the case where the sheet S is transported along the first sheet transport path R1.

The sheet S with an image formed thereon by the image forming apparatus 1 passes through the sheet insertion apparatus 2, and is transported from the receiving port 301 into the post-processing apparatus 3.

In the post-processing apparatus 3, the inclination detecting unit 303 first detects an inclination in the direction perpendicular to the flow of the sheet S.

Subsequently, the first inclination correcting unit 304 and the second inclination correcting unit 305 correct the inclination.

Then, the positions of the opposite ends of the sheet S are detected by the end position detecting unit 306.

Thereafter, the fold line forming unit 307 forms a fold line.

Further, the side edge removing section 308 removes the side edges of the sheet S.

Then, an initially transported sheet S (hereinafter referred to as a "preceding sheet S") is sent into the first branch path R11. Then, the preceding sheet S temporarily remains (waits) on the first branch path R11.

Then, a subsequently transported sheet S (hereinafter referred to as a "succeeding sheet S") is sent into the second branch path R12.

Then, the preceding sheet S and the succeeding sheet S that are stacked (hereinafter referred to as "stacked sheets S") are transported toward the ejection port 302.

The first branch path R11 and the second branch path R12 have a buffer function that prevents a reduction in the throughput of the image forming apparatus 1 and the like when time-consuming processing such as processing for folding a sheet bundle follows thereafter. In other words, the first branch path R11 and the second branch path R12 form a buffer unit 310.

For example, in the case where the buffer unit 310 is not provided, if time-consuming processing such as processing for folding a sheet bundle follows, an image forming operation in the image forming apparatus 1 having a higher processing efficiency than the folding processing needs to be stopped. Consequently, the overall processing efficiency is reduced.

On the other hand, in the case where the buffer unit 310 is provided, even if time-consuming processing follows, it is possible to continuously perform an image forming operation in the image forming apparatus 1.

More specifically, since the provision of the second branch path R12 into which the succeeding sheet S is sent is provided, even if time-consuming processing follows, it is possible to continuously perform an image forming operation in the image forming apparatus 1 by sending the succeeding sheet S into the second branch path R12. Thus, a reduction in processing efficiency is prevented.

Note that in the case where processing that follows the processing in the post-processing apparatus 3 does not take time, either one of the first branch path R11 and the second branch path R12 may be used.

Next, a description will be given of the case where the sheet S is transported along the second sheet transport path R2 branching off the first sheet transport path R1.

In the case of not using the processing units included in the post-processing apparatus 3, namely, the fold line forming unit 307 that forms a fold line in the sheet S, the side edge removing section 308 that removes the side edges of the sheet S, and the buffer unit 310 including the first branch path R11 and the second branch path R12, the sheet S is transported using the second sheet transport path R2 branching off the first sheet transport path R1.

The sheet S with an image formed thereon by the image forming apparatus 1 passes through the sheet insertion apparatus 2, and is transported from the receiving port 301 into the post-processing apparatus 3.

In the post-processing apparatus 3, the inclination detecting unit 303 first detects an inclination of the sheet S.

Subsequently, the first inclination correcting unit 304 corrects the inclination. Then, the sheet S with the inclination corrected is sent toward the ejection port 302 via the second sheet transport path R2.

In other words, the second sheet transport path R2 serves as a bypass bypassing the processing units of the post-processing apparatus 3.

In the case of not passing through the processing units of the post-processing apparatus 3, the transport time of the sheet S is reduced. Further, the length of the path through which the sheet S passes is less than in the case where the sheet S passes through the processing units. Therefore, the load imposed on the sheet S is less, and the sheet S is less likely to be smeared or damaged.

Accordingly, each sheet S is controlled so as to pass through the first sheet transport path R1 passing through the processing units of the post-processing apparatus 3 in the case where the sheet S uses any of the processing units, and to pass through the second sheet transport path R2 bypassing the processing units of the post-processing apparatus 3 in the case where the sheet S does not use any of the processing units.

Next, a description will be given of the side edges CS of the sheet S.

Figure 3B:
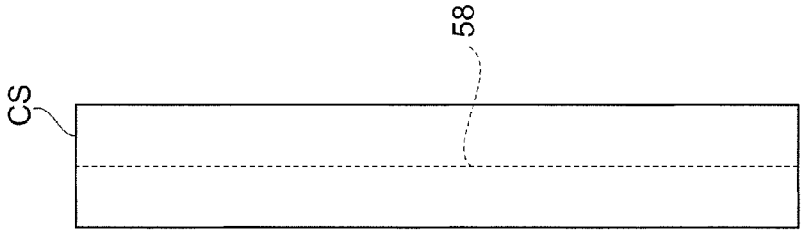
Figure 3A:
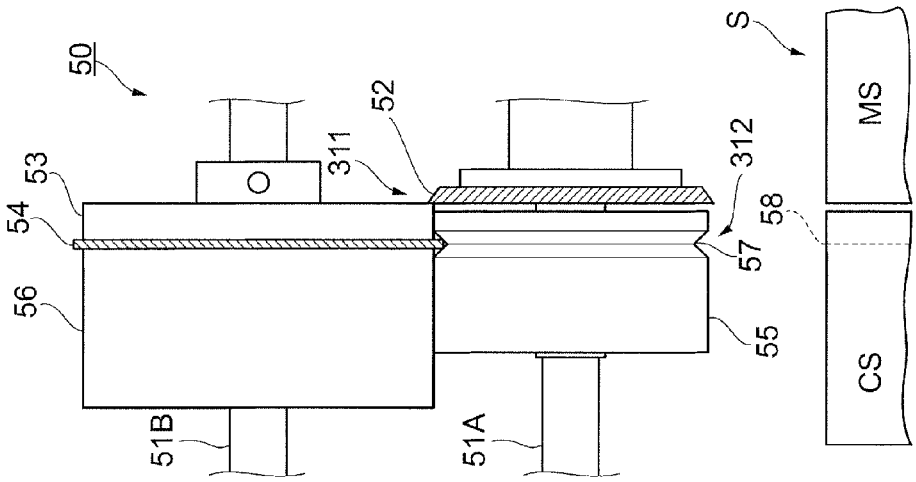

FIGS. 3A and 3B are diagrams illustrating the cutter unit 50 of the side edge removing section 308. FIG. 3A is a diagram illustrating the configuration of the cutter unit 50, and FIG. 3B is a diagram illustrating the side edge CS of the sheet S.

The side edge removing section 308 includes the two cutter units 50 disposed in the direction perpendicular to the flow of the sheet S. With these, the side edges CS of the opposite ends of the sheet S in the direction of the flow of the sheet S are removed (trimmed vertically). Note that, in FIG. 3A, the cutter unit disposed at the left side with respect to the flow of the sheet S is illustrated.

The cutter unit 50 includes a cutter part 311 as an example of a side edge removing unit and a crease forming unit 312 as an example of a rigidity imparting unit.

The cutter part 311 includes a rotary cutter 52, which is a disc-shaped blade, and a cylindrical pressing member 53 against which the rotary cutter 52 is pressed.

The crease forming unit 312 includes a circular plate 54 and a groove 57 that receives the edge of the circular plate 54.

Further, the rotary cutter 52, the pressing member 53, the circular plate 54, and the groove 57 are disposed on shafts 51A and 51B formed of two metal rods that are arranged parallel to the direction orthogonal to the flow of the sheet S.

More specifically, the rotary cutter 52 and a cylindrical elastic body 55 which is made of rubber or the like and in which the groove 57 is formed are disposed with a predetermined interval therebetween on the shaft 51A.

On the other hand, the pressing member 53 against which the rotary cutter 52 is pressed, the circular plate 54 adjacent to the pressing member 53, and an elastic body 56 which is made of rubber or the like and is adjacent to the circular plate 54 are disposed on the shaft 51B. The outer diameter of the circular plate 54 is greater than that of the pressing member 53. Therefore, the outer periphery of the circular plate 54 extends outward beyond the pressing member 53. Note that the outer diameter of the elastic body 56 is set to have the same outer diameter as the pressing member 53.

Further, the outer periphery of the circular plate 54 is arranged so as to fit in the groove 57 provided in the elastic body 55.

Further, the elastic body 55 and the elastic body 56 are in contact with each other such that the driving force is transmitted.

Accordingly, when the shaft 51A is rotated by a motor, the elastic body 55 on the shaft 51A rotates, and the driving force is transmitted to the elastic body 56 of the shaft 51B, so that the shaft 51B rotates. Thus, the sheet S held between the rotary cutter 52 and the pressing member 53 is cut into a side edge CS and a body MS. Note that a pressure is applied to the rotary cutter 52 and the pressing member 53 by a spring (not illustrated) or the like such that the rotary cutter 52 and the pressing member 53 engage each other.

In this example, as illustrated in FIG. 3A, the sheet S is cut such that the side edge CS of the sheet S is on the side on which the circular plate 54 is disposed and the body MS of the sheet S is on the side on which the circular plate 54 is not disposed.

Accordingly, the circular plate 54 on the shaft 51B is pressed against the groove 57 of the elastic body 55 on the shaft 51A, so that the crease 58 is formed.

As illustrated in FIG. 3B, the crease 58 is formed along the side edge CS of the sheet S in the direction of the flow of the sheet S.

For example, in the case where the width of the side edge of the sheet S is in a range from 7 mm to 25 mm, the distance from the rotary cutter 52 is 5 mm such that the crease 58 is formed even when the width of the side edge CS is the minimum width of 7 mm. Accordingly, the crease 58 is formed along the elongated side edge CS.

The side edge with the crease 58 formed therein is less easily bent in the direction orthogonal to the crease 58, compared to the case where the crease 58 is not formed. That is, the rigidity is increased by forming the crease 58.

Then, as illustrated in FIG. 2, the side edge CS of the sheet S moves diagonally (toward the lower right FIG. 2) from the section β along a guide so as to be stored in the chip storing unit 309.

Note that the body MS of the sheet S is transported from the section β to the first branch path R11 or the second branch path R12 along a guide.

That is, the side edge CS with the crease 58 formed therein is not easily bent and is likely to maintain the shape of a rod.

Figure 4A:
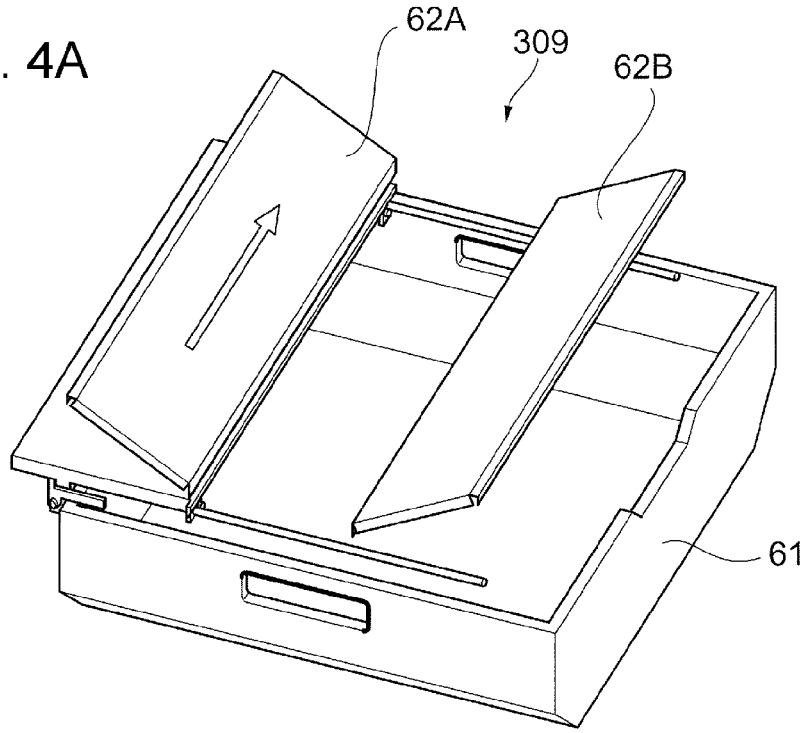
Figure 4B:
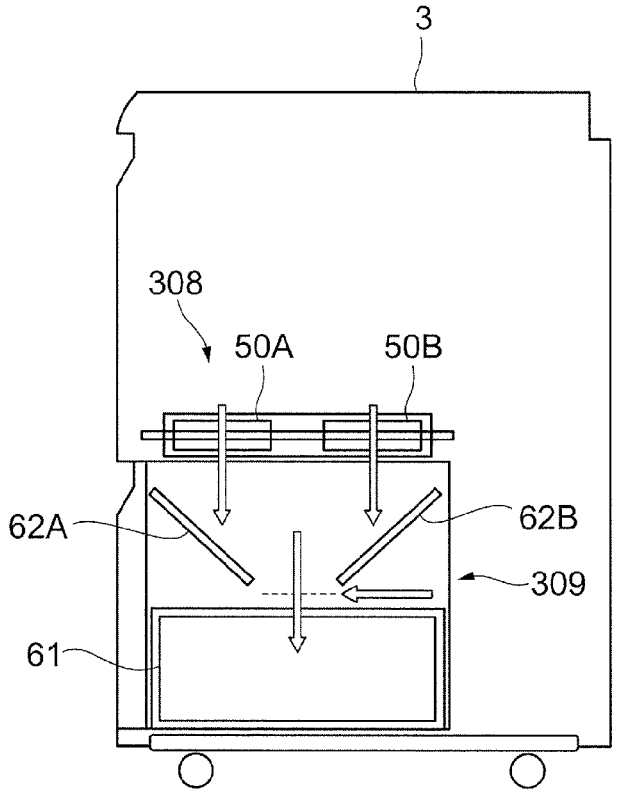

FIGS. 4A and 4B are diagrams illustrating the configuration of the chip storing unit 309. FIG. 4A is a perspective view of the chip storing unit 309, and FIG. 4B is a side view of the chip storing unit 309 in the post-processing apparatus 3. Note that FIG. 4B illustrates a side perpendicular to a side of the post-processing apparatus 3 illustrated in FIG. 2.

As illustrated in FIG. 4A, the chip storing unit 309 includes a chip storing box 61, side edge guides 62 (62A and 62B) as an example of a guide plate.

The chip storing box 61 stores the cut off side edges CS. Each of the side edge guides 62 includes an obliquely disposed plate-shaped member. As illustrated in FIG. 4A, the side edge guides 62A and 62B are disposed on the left and right, respectively. In this example, the side edge guides 62A and 62B are arranged in the shape of V with an open bottom.

As illustrated in FIG. 4B, the two cutter units 50 are provided as cutter units 50A and 50B at the left and right, respectively. The side edge guide 62A is disposed so as to correspond to the cutter unit 50A, and the side edge guide 62B is disposed so as to correspond to the cutter unit 50B.

Thus, when the side edge CS with the crease 58 formed therein falls from the cutter unit 50A, an end of the side edge CS is guided by the sloping surface of the side edge guide 62A so as to slide in the lateral direction (a direction of the arrow in FIG. 4A) on the sloping surface into the chip storing box 61. That is, the direction of the side edge CS is aligned with the direction perpendicular to the sloping surface of the side edge guide 62A. Then, the side edge CS rolls over the sloping surface of the side edge guide 62A so as to be stored through the gap between the side edge guides 62A and 62B into the chip storing box 61.

In the case where the side edge CS with the crease 58 formed therein falls from the cutter unit 50B, the side edge CS is guided by the sloping surface of the side edge guide 62B, so that the direction of the side edge CS is aligned with the direction perpendicular to the sloping surface of the side edge guide 62B. Then, the side edge CS rolls over the sloping surface of the side edge guide 62B, and is stored in the chip storing box 61.

That is, the sloping surfaces of the side edge guides 62A and 62B are inclined in the direction orthogonal to the longitudinal direction of the side edge CS. Note that the sloping surfaces of the side edge guides 62A and 62B do not necessarily need to be flat, and may be surfaces curved upward or downward.

In this example, the side edges CS accumulate at the center of the chip storing box 61. However, since the side edges CS have a high rigidity, the side edges CS are less likely to tangle each other. Accordingly, the side edges accumulated at the center of the chip storing box 61 collapse and are evened out in the chip storing box 61.

Figure 5A:
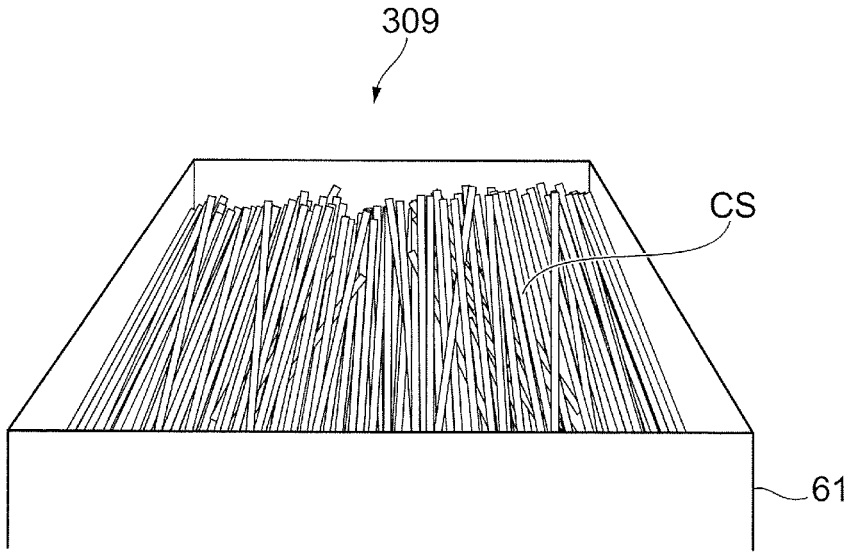
FIG. 5A is a schematic diagram illustrating a state of side edges according to the exemplary embodiment which are stored in a chip storing box.
Figure 5B:
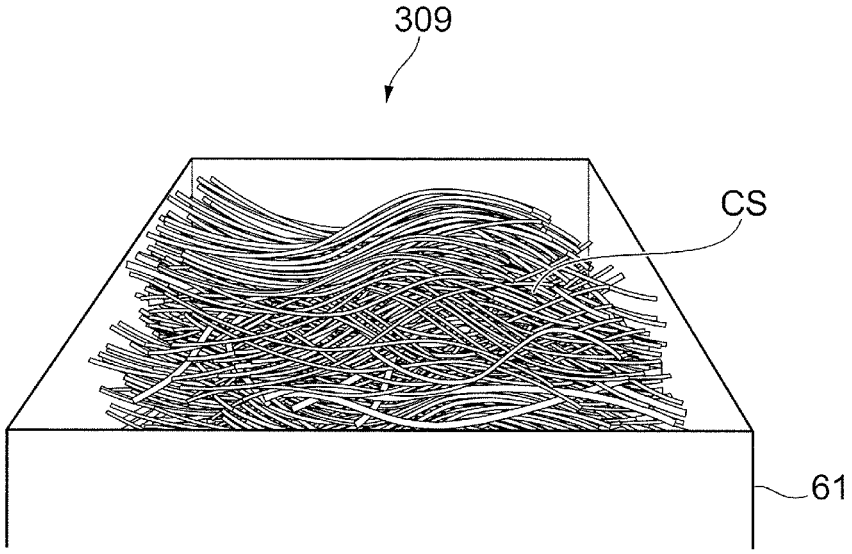
FIG. 5B is a schematic diagram illustrating a state of side edges not according to the exemplary embodiment which are stored in the chip storing box.

FIG. 5A is a schematic diagram illustrating a state of side edges CS according to this exemplary embodiment which are stored in the chip storing box 61. FIG. 5B is a schematic diagram illustrating a state of side edges CS not according to this exemplary embodiment which are stored in the chip storing box 61.

The side edges CS not according to this exemplary embodiment are side edges CS in which creases 58 are not formed.

As illustrated in FIG. 5A, the side edges CS according to this exemplary embodiment have a high rigidity in the direction along the side edges CS, that is, in the longitudinal direction thereof. Therefore, the side edges CS are aligned and in stored neatly in the chip storing box 61. Thus, the storage efficiency is increased compared to the case of FIG. 5B in which creases 58 are not formed.

On the other hand, as illustrated in FIG. 5B, in the case where creases 58 are not formed unlike this exemplary embodiment, the side edges CS have a low rigidity and therefore are bent when stored. Thus, the storage efficiency is reduced.

Figure 6A:
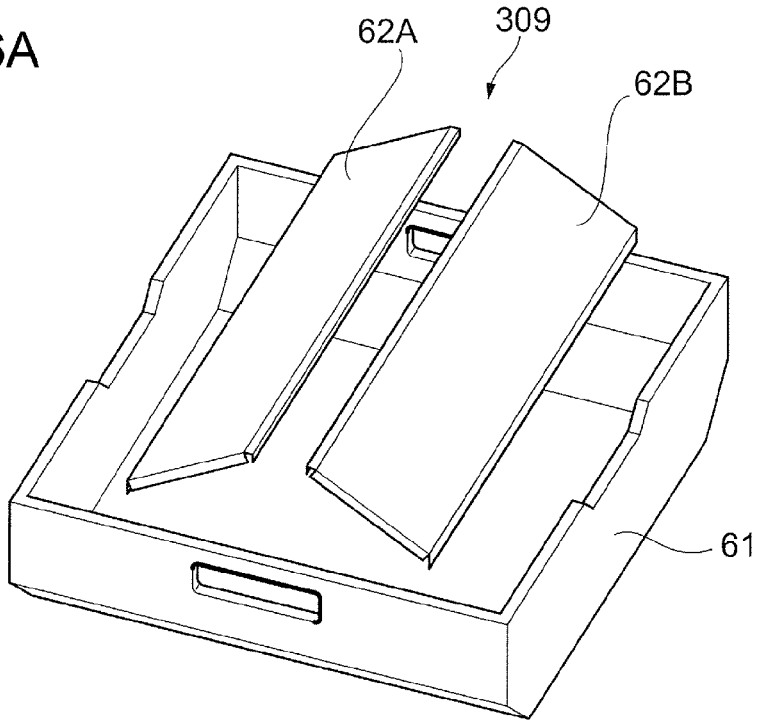
Figure 6B:
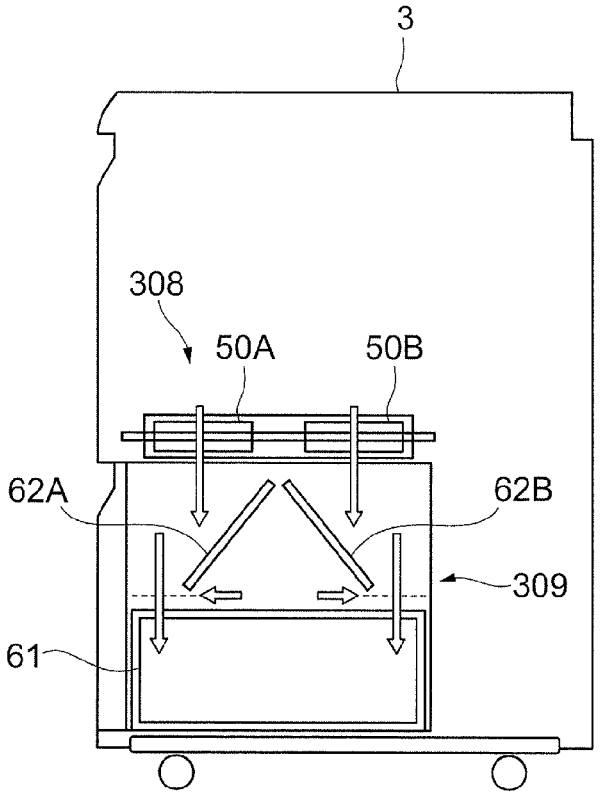

FIGS. 6A and 6B are diagrams illustrating another configuration of the chip storing unit 309. FIG. 6A is a perspective view of the chip storing unit 309, and FIG. 6B is a side view of the chip storing unit 309 in the post-processing apparatus 3.

In FIGS. 6A and 6B, the sloping surfaces of the side edge guides 62 are in the orientation opposite to that of FIGS. 4A and 4B so as to be in the shape of an inverted V with an open top. The configuration other than this is the same as that of FIGS. 4A and 4B. Accordingly, the following discusses the differences, and does not describe features identical to those of FIGS. 4A and 4B.

When the orientation of the sloping surfaces of the side edge guides 62 is inverted, the side edges CS having fallen from the cutter units 50 of the side edge removing section 308 fall into the opposite ends of the chip storing box 61. Thus, the side edges CS accumulate at the opposite ends of the chip storing box 61. However, as mentioned above, since the side edges CS have a high rigidity, the side edges CS accumulated at the opposite ends of the chip storing box 61 collapse and are evened out in the chip storing box 61.

Accordingly, the efficiency of storing side edges CS is higher than in the case where creases 58 are not formed.

Note that upon forming creases 58 in the side edge CS, the sheet S is pulled outward. However, since creases 58 are formed on the opposite side edges concurrently, the sheet S is pulled from the opposite sides. Therefore, the sheet S is not likely to be distorted.

Further, in parallel with cutting the side edge CS of the sheet S with the rotary cutter 52 of the cutter part 311, the crease 58 is formed in the side edge CS by the crease forming unit 312. Therefore, there is no need to provide another drive mechanism. Note that a separate drive mechanism may be provided for forming a crease 58 in a side edge CS.

In the above example, the rigidity of the side edge CS is increased by forming the crease 58 in the longitudinal direction of the side edge CS. However, the rigidity may be increased by other methods. For example, a crease 58 may be formed in a zig-zag pattern in the longitudinal direction.

In the above example, the edge of the circular plate 54 abuts against the groove 57 so as to form a crease. In this case, the edge of the circular plate 54 may be chamfered and curved. Further, the thickness of the circular plate 54 may be set such that the side edge CS may be recessed in an angular U-shape.

Further, in order to increase the efficiency of storing side edges CS in the chip storing unit 309, the side edge CS may be cut in the longitudinal direction into strips. In this case, however, a mechanism for processing the side edge into strips needs to be provided, and noise might be generated.

In this exemplary embodiment, the post-processing apparatus 3 includes the fold line forming unit 307 and the side edge removing section 308. However, a processing unit that performs other processing may be provided in addition to either one of or both of these units. Further, a processing unit that performs other processing may be provided separately from these units.

Further, the present invention is not limited to the exemplary embodiment described above.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A post-processing apparatus comprising:

a side edge removing unit configured to remove a side edge of a sheet; and a rigidity imparting unit configured to impart rigidity to the side edge that is removed by the side edge removing unit such that the side edge has a higher rigidity in a longitudinal direction of the side edge than a body of the sheet from which the side edge is removed, wherein the rigidity imparting unit is configured to form a crease in the side edge that is removed by the side edge removing unit, and wherein the rigidity imparting unit comprises a circular plate and a groove configured to receive an edge of the circular plate.

2. The post-processing apparatus according to claim 1, wherein the side edge removing unit and the rigidity imparting unit are configured to operate in parallel.

3. The post-processing apparatus according to claim 1, further comprising:

a side edge storing unit configured to store the side edge removed by the side edge removing unit;

wherein the side edge storing unit comprises a guide plate inclined in a direction orthogonal to a direction in which the rigidity of the side edge is increased, the guide plate being configured to guide the side edge.

4. The post-processing apparatus according to claim 3, wherein the guide plate is configured to guide the side edge toward a center of the side edge storing unit.

5. The post-processing apparatus according to claim 3, wherein the guide plate is configured to guide the side edge toward an end of the side edge storing unit.

6. An image forming system comprising:

an image forming apparatus configured to form an image on a sheet; and a post-processing apparatus comprising a side edge removing unit configured to remove a side edge of the sheet on which the image is formed by the image forming apparatus, and a rigidity imparting unit configured to impart rigidity to the side edge that is removed by the side edge removing unit such that the side edge has a higher rigidity in a longitudinal direction of the side edge than a body of the sheet from which the side edge is removed, wherein the rigidity imparting unit is configured to form a crease in the side edge that is removed by the side edge removing unit, and wherein the rigidity imparting unit comprises a circular plate and a groove configured to receive an edge of the circular plate.

7. A post-processing apparatus comprising:

a side edge removing unit configured to remove a side edge of a sheet; and a rigidity imparting unit configured to impart rigidity to the side edge that is removed by the side edge removing unit such that the side edge has a higher rigidity in a longitudinal direction of the side edge than a body of the sheet from which the side edge is removed, wherein the side edge removing unit comprises a rotary cutter, and wherein the rigidity imparting unit comprises a circular plate and a groove configured to receive an edge of the circular plate.

8. The post-processing apparatus according to claim 7, wherein the circular plate is configured to be pressed against the groove to form a crease in the side edge.

9. The post-processing apparatus according to claim 7, further comprising a first shaft and a second shaft, wherein the rotary cutter, the groove, and a first elastic body are disposed on the first shaft, wherein the circular plate, a pressing member, and a second elastic body are disposed on the second shaft, wherein the rotary cutter is configured to press against the pressing member, and wherein the first elastic body is configured to press against the second elastic body.

10. The post-processing apparatus according to claim 9, further comprising a spring that is configured to press the rotary cutter against the pressing member.

* * * * *